US008622875B2

(12) United States Patent
Ho

(10) Patent No.: US 8,622,875 B2
(45) Date of Patent: Jan. 7, 2014

(54) DOORFRAME SUSPENSION TYPE PARALLEL-BAR EXERCISING APPARATUS

(76) Inventor: Wei-Teh Ho, Taipei (TW)

( * ) Notice: Subject to any disclaimer, the term of this patent is extended or adjusted under 35 U.S.C. 154(b) by 198 days.

(21) Appl. No.: 13/199,148

(22) Filed: Aug. 22, 2011

(65) Prior Publication Data

US 2013/0053221 A1 Feb. 28, 2013

(51) Int. Cl.
*A63B 1/00* (2006.01)
*A63B 21/068* (2006.01)

(52) U.S. Cl.
USPC ..... 482/40; 482/96

(58) Field of Classification Search
USPC ..... 482/38–43, 92–96, 131, 904
See application file for complete search history.

(56) References Cited

U.S. PATENT DOCUMENTS

| | | | | |
|---|---|---|---|---|
| 4,529,191 | A * | 7/1985 | Miller et al. | 482/40 |
| 4,844,448 | A * | 7/1989 | Niznik | 482/40 |
| 5,417,628 | A * | 5/1995 | Vanderbleek | 482/40 |
| 7,621,847 | B2 * | 11/2009 | Lamle et al. | 482/40 |
| 2012/0046150 | A1 * | 2/2012 | Stacey | 482/131 |
| 2012/0094808 | A1 * | 4/2012 | Leier | 482/40 |
| 2012/0115684 | A1 * | 5/2012 | Nguyen | 482/40 |

* cited by examiner

*Primary Examiner* — Loan Thanh
*Assistant Examiner* — Jennifer M Deichl
(74) *Attorney, Agent, or Firm* — Jackson IPG PLLC

(57) ABSTRACT

A doorframe suspension type parallel-bar exercising apparatus includes two smoothly arched suspension bars connected in parallel by connection bars for hanging on the top rail of a doorframe, and a bearing bar transversely connected to the smoothly arched suspension bars for stopping at the inner side of the opposing left and right uprights of the doorframe, and two grips respectively affixed to the rear ends of the smoothly arched suspension bars.

4 Claims, 10 Drawing Sheets

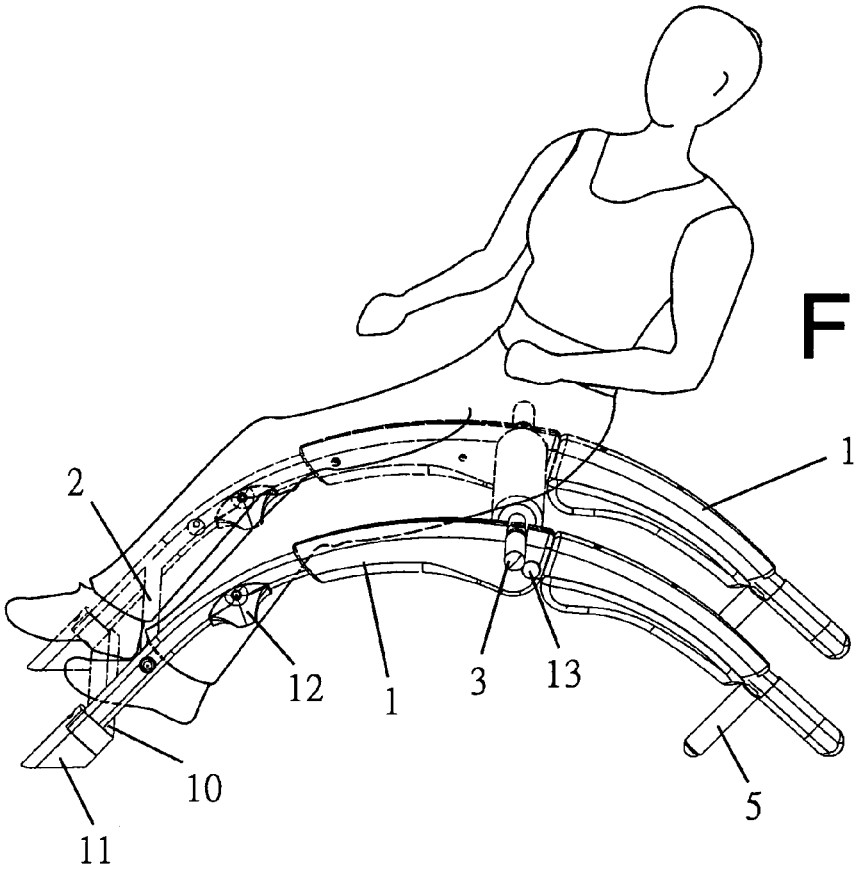
FIG.11
FIG.12
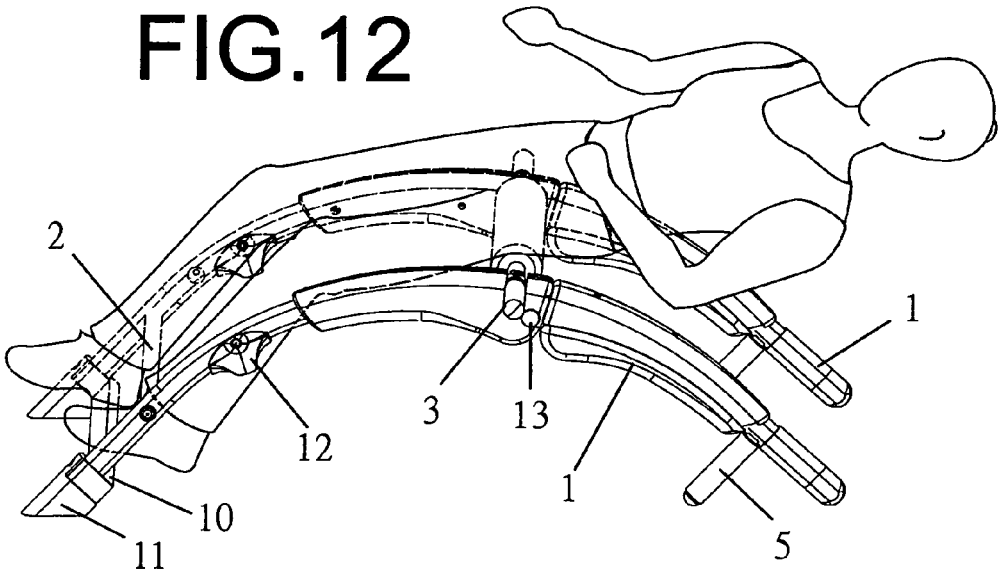

DOORFRAME SUSPENSION TYPE PARALLEL-BAR EXERCISING APPARATUS

BACKGROUND OF THE INVENTION

1. Field of the Invention

The present invention relates to exercising apparatus and more particularly, to doorframe suspension type parallel-bar exercising apparatus, which has compact size and low cost characteristics.

2. Description of the Related Art

Due to unbalanced diet and lack of physical activity, people care about their body health. In consequence, many exercising apparatus have been created for home application. There exercising apparatus are commonly heavy and expensive. There is a strong demand for compact and inexpensive exercising apparatus for home application.

SUMMARY OF THE INVENTION

The present invention has been accomplished under the circumstances in view. It is one object of the present invention to provide a doorframe suspension type parallel-bar exercising apparatus, which has compact size and low cost characteristics.

To achieve this and other objects of the present invention, a doorframe suspension type parallel-bar exercising apparatus comprises: two smoothly arched suspension bars arranged in parallel, each suspension bar having an end block fixedly connected to a front end thereof, the end block defining therein a locating notch for hanging on a top rail of the doorframe, which defines therein a transverse width greater than the transverse distance between the two smoothly arched suspension bars; a plurality of connection bars transversely connected between the smoothly arched suspension bars; and a bearing bar transversely connected to the smoothly arched suspension bars, the bearing bar having two distal ends thereof respectively suspending outside the smoothly arched suspension bars, the bearing bar having a length greater than the transverse width of the doorframe.

BRIEF DESCRIPTION OF THE DRAWINGS

FIG. 11 is a schematic applied view of the doorframe suspension type parallel-bar exercising apparatus in accordance with the present invention (V).

FIG. 12 is a schematic applied view of the doorframe suspension type parallel-bar exercising apparatus in accordance with the present invention (VI).

DETAILED DESCRIPTION OF THE PREFERRED EMBODIMENT

Figure 1:
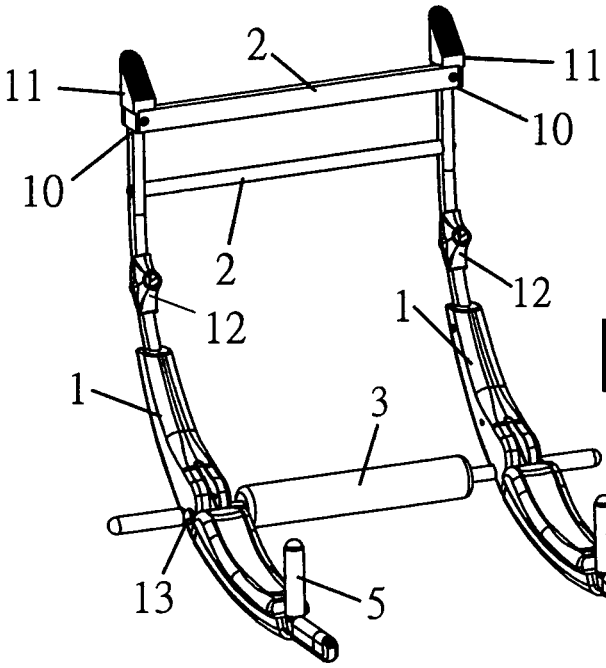
FIG. 1 is an elevational view of a doorframe suspension type parallel-bar exercising apparatus in accordance with the present invention.

Referring to FIGS. 1~15, a doorframe suspension type parallel-bar exercising apparatus in accordance with the present invention is shown comprising two suspension bars 1, at least one, for example, two connection bars 2, and a bearing bar 3.

The two suspension bars 1 are smoothly arched and arranged in parallel. The connection bars 2 are transversely connected between the suspension bars 1 in such a manner that the width of the assembly of the suspension bars 2 and the connection bars 2 is smaller than the width of a doorframe 4. Each suspension bar 1 has an end block 11 located on one end, namely, the front end thereof. The end block 11 defines therein a locating notch 10. The bearing bar 3 is transversely connected to the middle part of each of the two suspension bars 1. The length of the bearing bar 3 is greater than the width of the doorframe 4.

Further, two grips 5 are respectively affixed to the other ends, namely, the rear ends of the suspension bars 1. Further, a rope 6 is coupled between the two grips 5. Further, each suspension bar 1 can be made having a pivoted rear part 14 that is biasable between a collapsed position and an extended position and can be locked in the extended position by a lock pin 13. Further, a retaining block 12 is arranged at each suspension bar 1 for receiving the associating grip 5 in a collapsed position.

Figure 2:
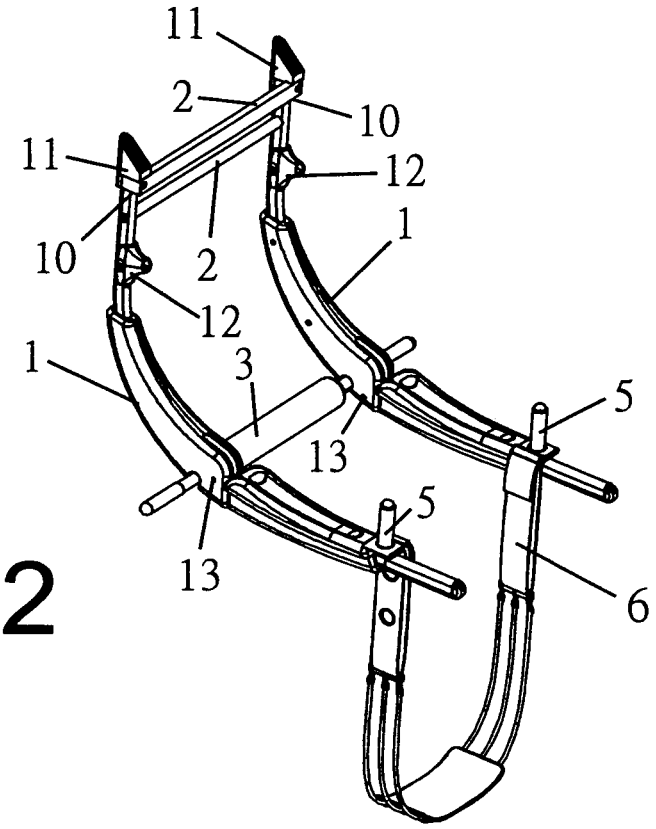
FIG. 2 corresponds to FIG. 1, illustrating a rope coupled between the grips.
Figure 3:
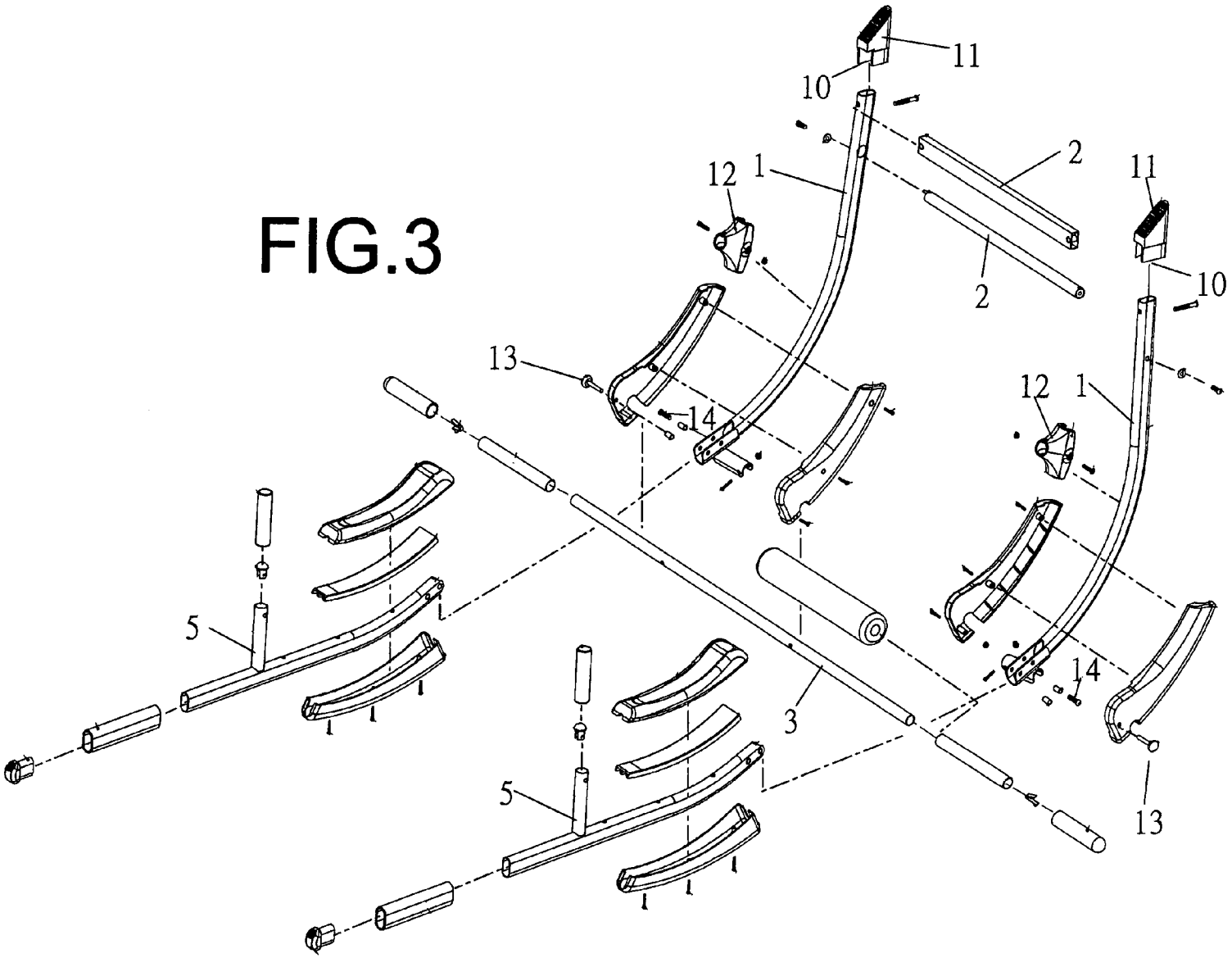
FIG. 3 is an exploded view of the doorframe suspension type parallel-bar exercising apparatus shown in FIG. 1.
Figure 4:
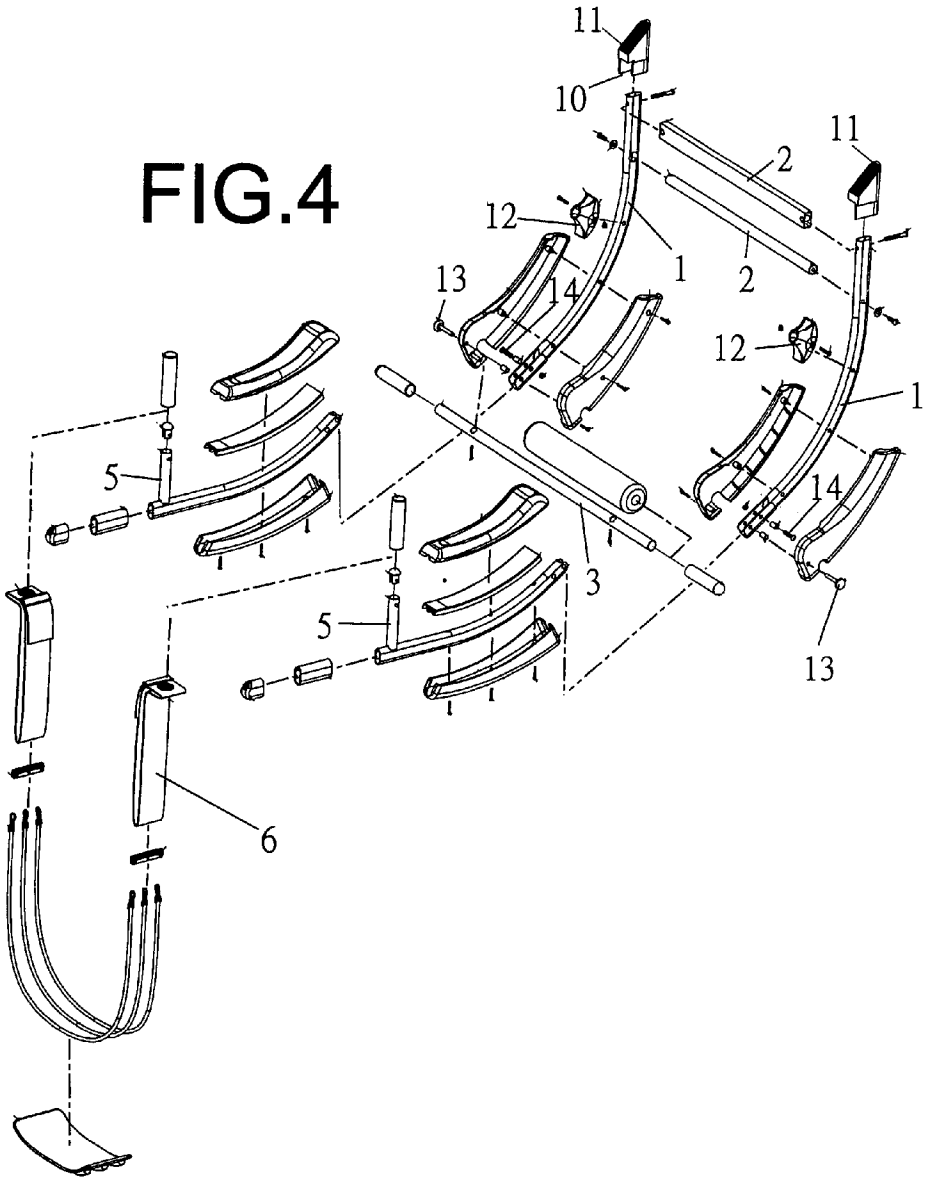
FIG. 4 is an exploded view of the doorframe suspension type parallel-bar exercising apparatus shown in FIG. 2.
Figure 6:
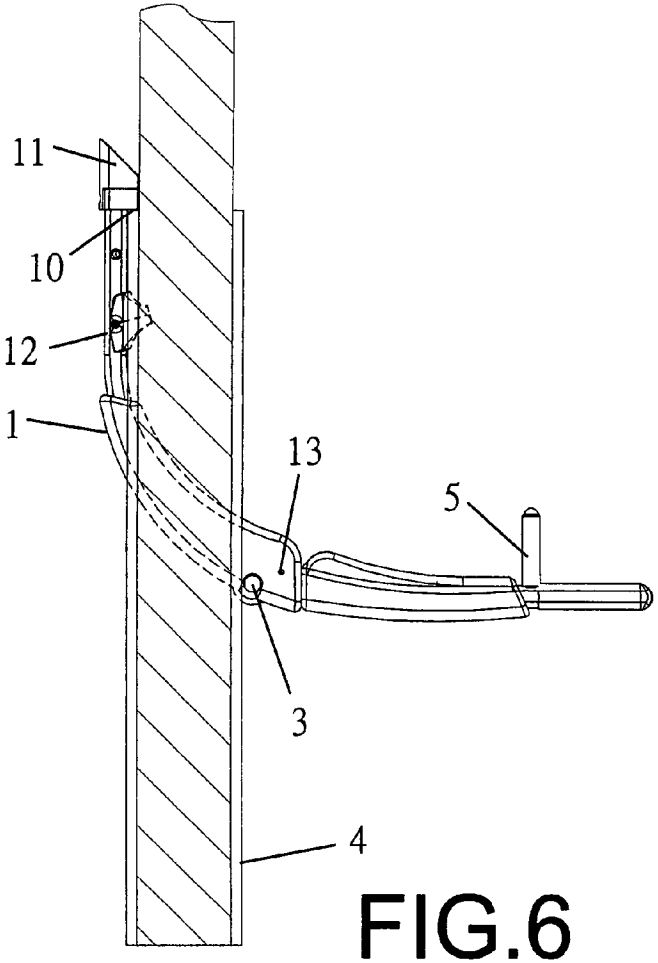
FIG. 6 is a side view of the doorframe suspension type parallel-bar exercising apparatus in accordance with the present invention.
Figure 5:
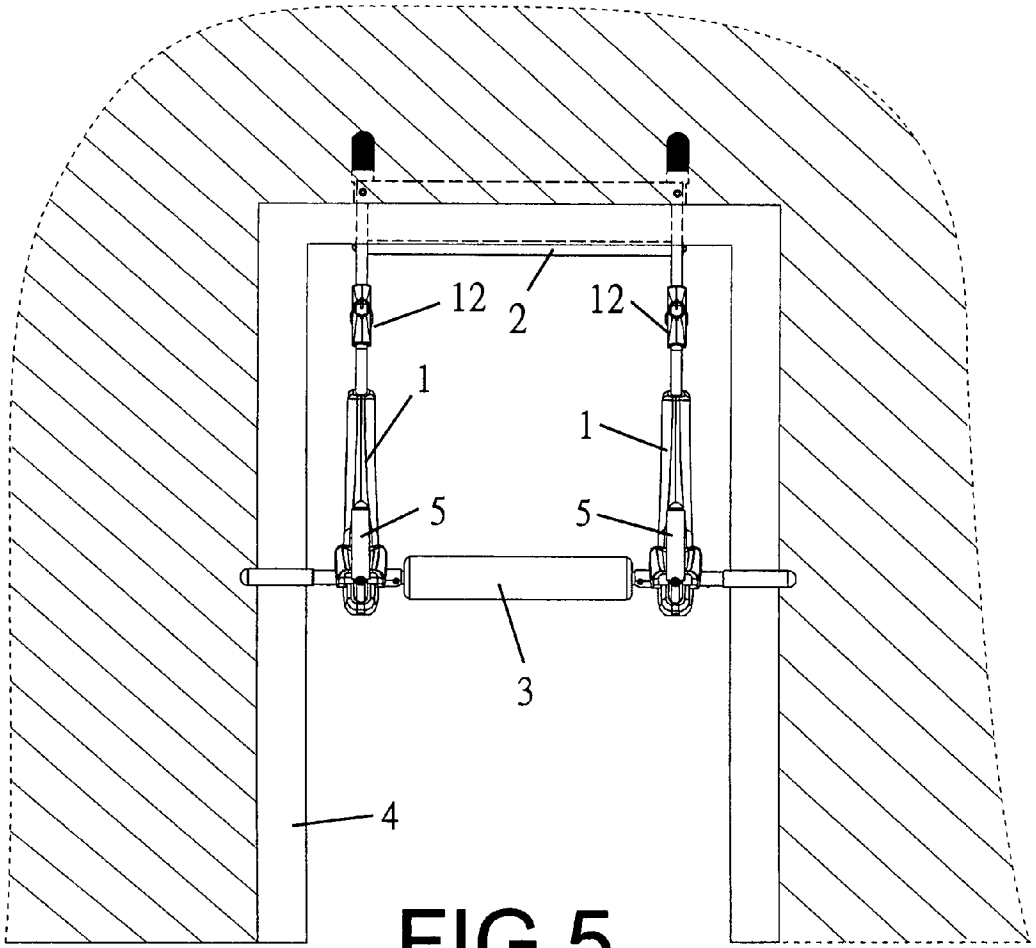
FIG. 5 is a front view of the doorframe suspension type parallel-bar exercising apparatus in accordance with the present invention.
Figure 8:
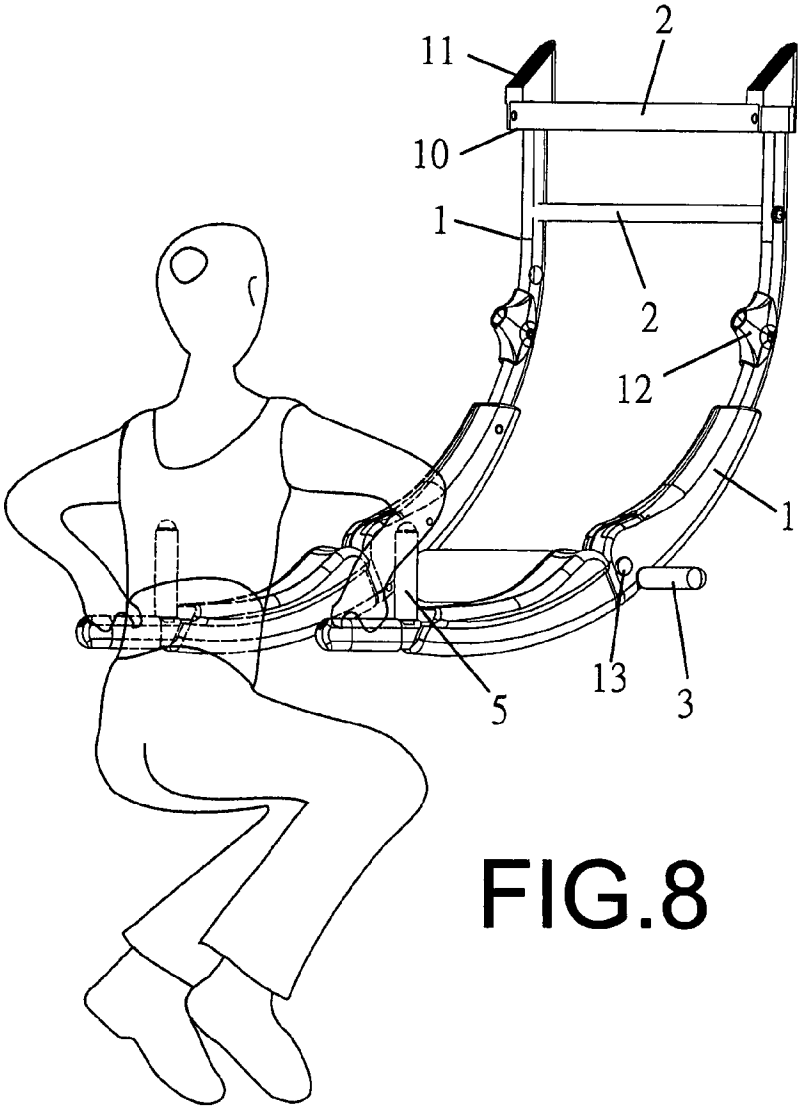
FIG. 8 is a schematic applied view of the doorframe suspension type parallel-bar exercising apparatus in accordance with the present invention (II).
Figure 7:
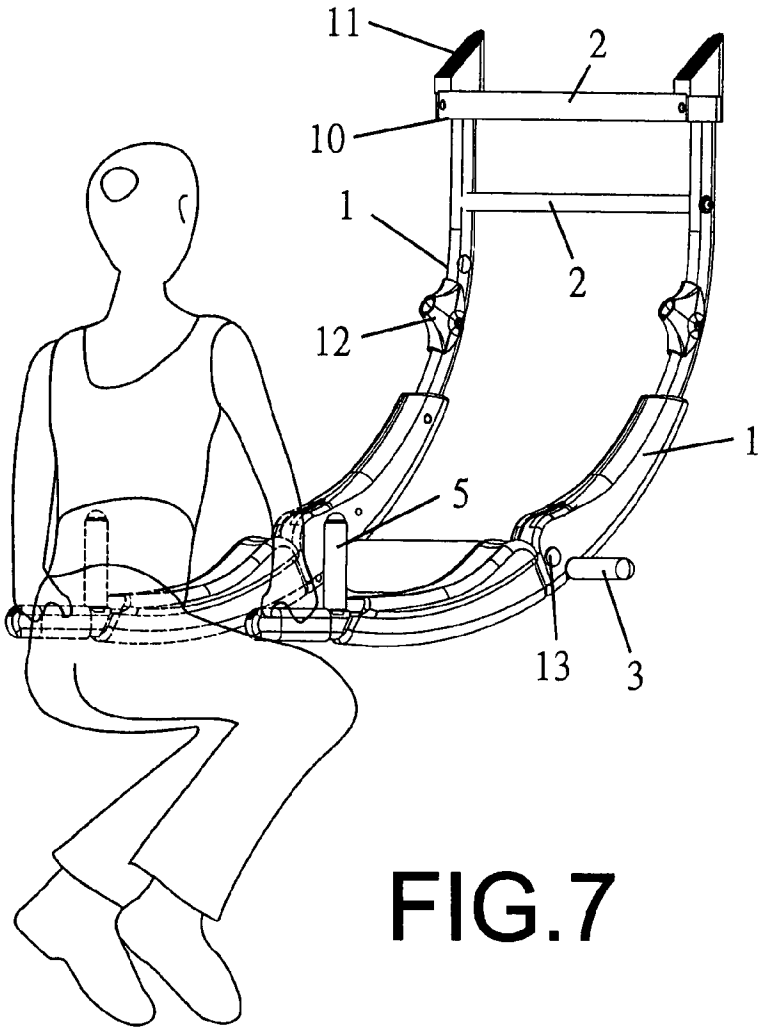
FIG. 7 is a schematic applied view of the doorframe suspension type parallel-bar exercising apparatus in accordance with the present invention (I).
Figure 10:
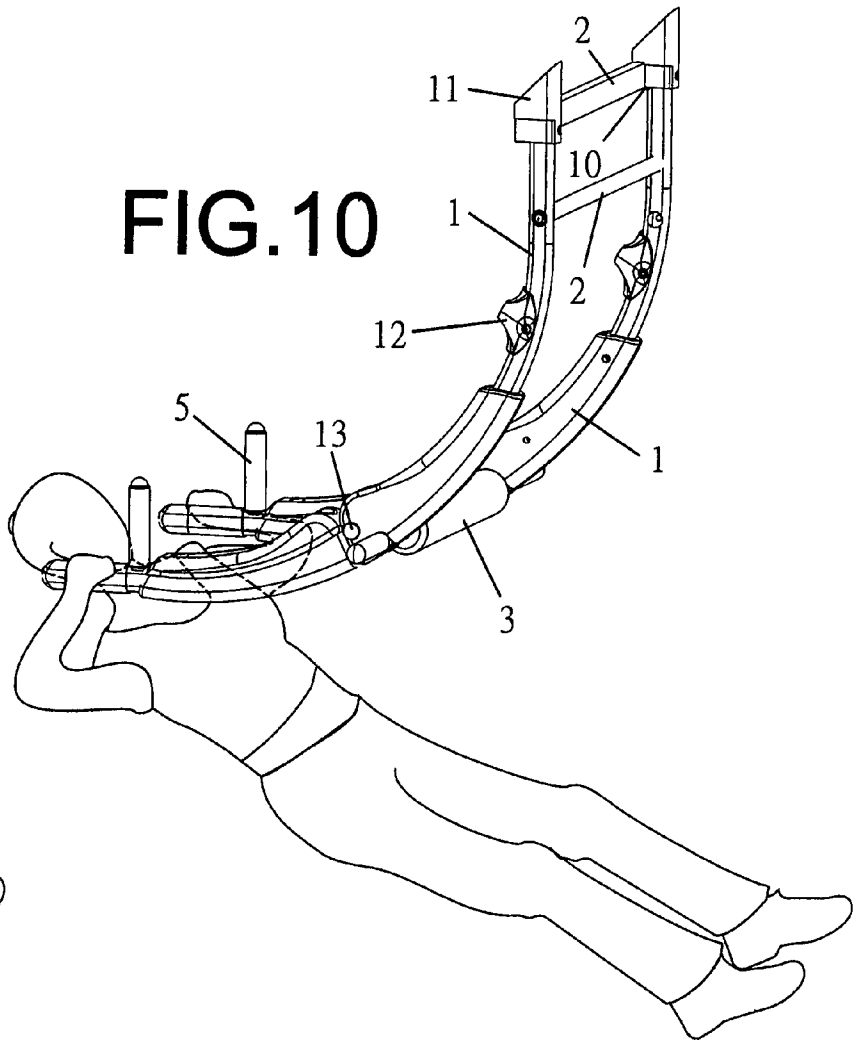
FIG. 10 is a schematic applied view of the doorframe suspension type parallel-bar exercising apparatus in accordance with the present invention (IV).
Figure 9:
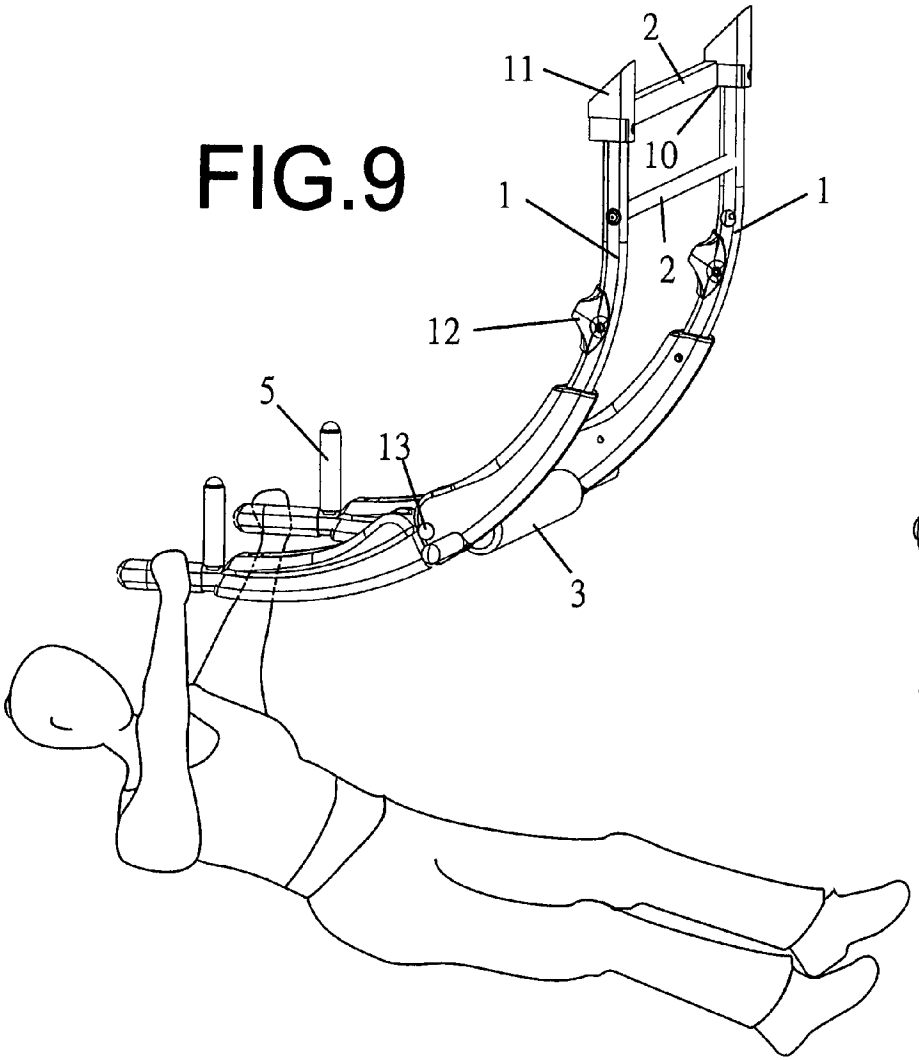
FIG. 9 is a schematic applied view of the doorframe suspension type parallel-bar exercising apparatus in accordance with the present invention (III).
Figure 13:
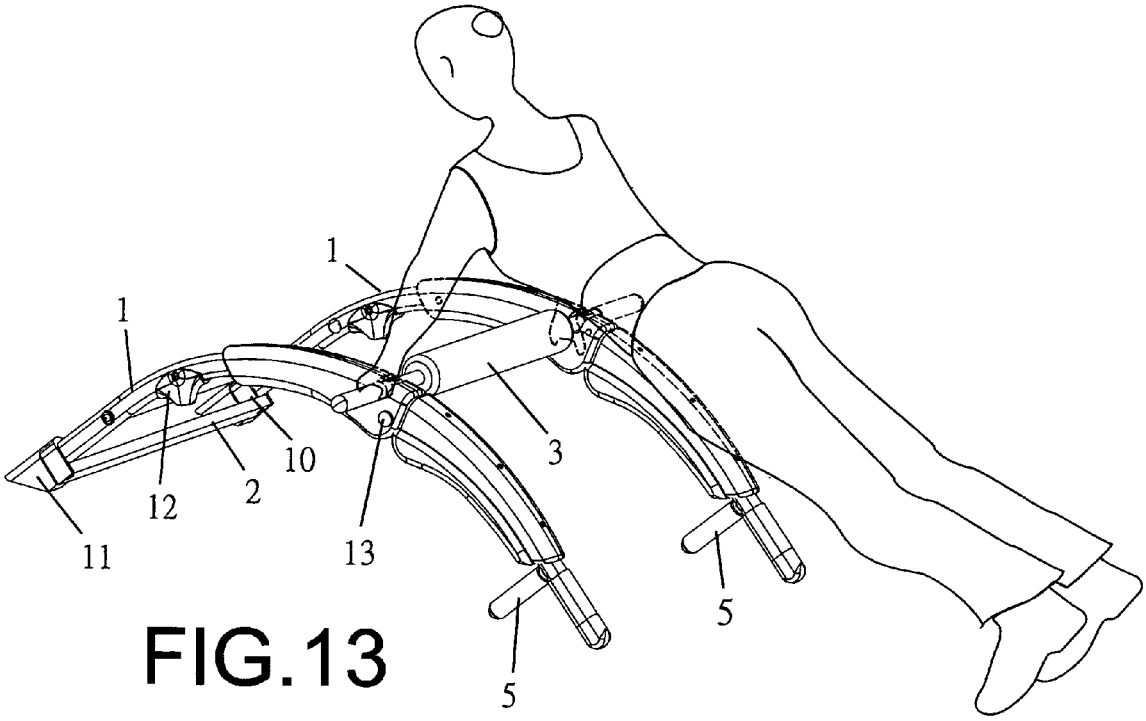
FIG. 13 is a schematic applied view of the doorframe suspension type parallel-bar exercising apparatus in accordance with the present invention (VII).
Figure 14:
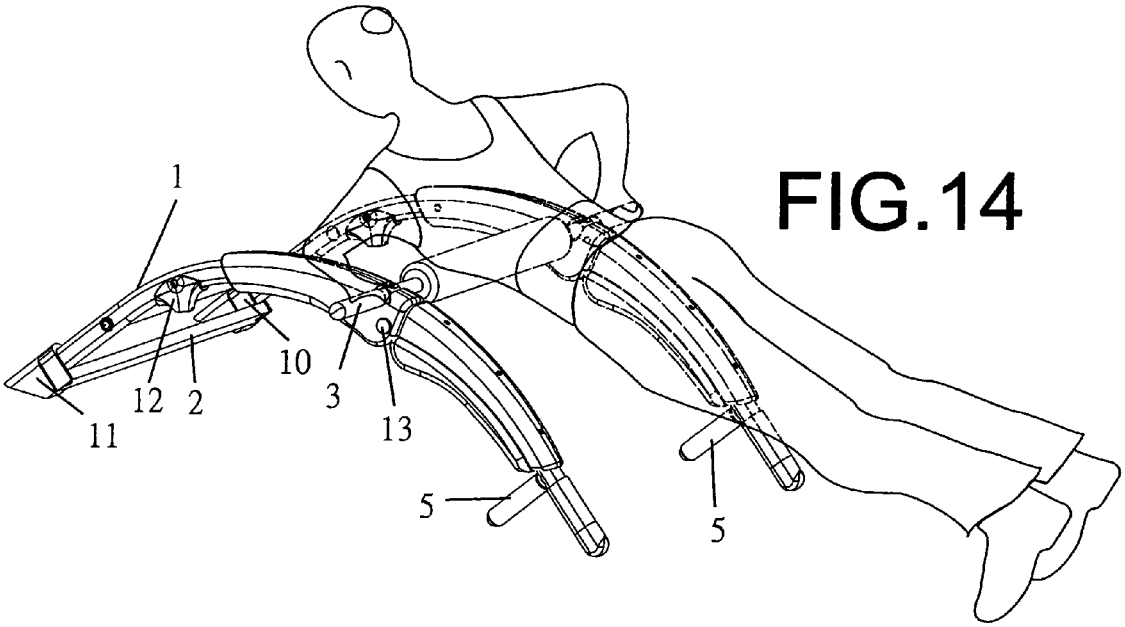
FIG. 14 is a schematic applied view of the doorframe suspension type parallel-bar exercising apparatus in accordance with the present invention (VIII).
Figure 15:
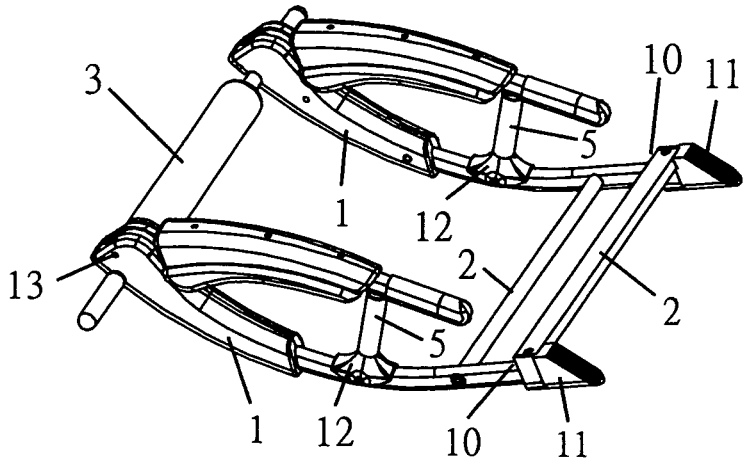
FIG. 15 is a schematic drawing of the present invention, illustrating the doorframe suspension type parallel-bar exercising apparatus collapsed.

When using the doorframe suspension type parallel-bar exercising apparatus, attach the locating notches 10 of the end blocks 11 of the suspension bars 1 to the outer side of the top rail of the doorframe 4 to suspend the doorframe suspension type parallel-bar exercising apparatus in the doorframe 4 and to have the two distal ends of the bearing bar 3 be stopped at the inner sides of the opposing left and right uprights of the doorframe 4. At this time, the user can hold the rear ends of the two suspension bars 1 with the two hands to perform different forward and backward exercise actions, as shown in FIGS. 8~10. The rope 6 can be coupled between the two grips 5, as shown in FIGS. 2~4, to perform different suspension or hanging actions in training the muscles of the chest, abdomen and/or hips. The user can also place the doorframe suspension type parallel-bar exercising apparatus on the floor, as shown in FIGS. 11~14, and then hold the suspension bars 1 of the two distal ends of the bearing bar 3 with the two hands and hook the feet on one transverse bar 2 to perform sit-up or push-up exercises.

Except the characteristics of compact size and low cost, the doorframe suspension type parallel-bar exercising apparatus is collapsible. After removal of the lock pins 3, the pivoted rear part 14 of each suspension bar 1 can be turned from the extended position to the collapsed position to let the grips 5 be respectively received in the respective retaining block 12.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A doorframe suspension type parallel-bar exercising apparatus, comprising:

two smoothly arched suspension bars arranged in parallel, each said suspension bar having an end block fixedly connected to a front end thereof, said end block defining therein a locating notch for hanging on a top rail of said a doorframe;

a plurality of connection bars transversely connected between said smoothly arched suspension bars;

a bearing bar transversely connected to said smoothly arched suspension bars, said bearing bar having two distal ends thereof respectively suspending outside said smoothly arched suspension bars, said bearing bar having a length greater than the transverse distance between said two smoothly arched suspension bars, wherein each said smoothly arched suspension bar comprises a pivoted rear part that is biasable between a collapsed position and an extended position and lockable in the extended position by a lock pin.

2. The doorframe suspension type parallel-bar exercising apparatus as claimed in claim 1, wherein each said smoothly arched suspension bar comprises a grip located on a rear end thereof.

3. The doorframe suspension type parallel-bar exercising apparatus as claimed in claim 1, further comprising two grips respectively affixed to a rear end of each of said smoothly arched suspension bars, and a rope coupled between said two grips.

4. A doorframe suspension type parallel-bar exercising apparatus, comprising:

two smoothly arched suspension bars arranged in parallel, each said suspension bar having an end block fixedly connected to a front end thereof, said end block defining therein a locating notch for hanging on a top rail of a doorframe;

a plurality of connection bars transversely connected between said smoothly arched suspension bars; and a bearing bar transversely connected to said smoothly arched suspension bars, said bearing bar having two distal ends thereof respectively suspending outside said smoothly arched suspension bars, said bearing bar having a length greater than the transverse distance between said two smoothly arched suspension bars; and, wherein each said suspension bar comprises:

a pivoted rear part that is biasable between a collapsed position and an extended position and lockable in the extended position by a lock pin;

a grip located on said pivoted rear part; and a retaining block adapted for receiving the associating grip in a collapsed position.

* * * * *